US010167593B2

(12) United States Patent
Tung et al.

(10) Patent No.: US 10,167,593 B2
(45) Date of Patent: Jan. 1, 2019

(54) APPARATUS AND METHOD FOR APPLYING COLORS AND PERFORMANCE CHEMICALS ON CARPET YARNS

(71) Applicants: INVISTA TECHNOLOGIES S.A.R.L., St. Gallen (CH); Wae-Hai Tung, Marietta, GA (US); Ronnie Rittenhouse, Calhoun, GA (US)

(72) Inventors: Wae-Hai Tung, Marietta, GA (US); Ronnie Rittenhouse, Calhoun, GA (US)

(73) Assignee: INVISTA NORTH AMERICA S.A.R.L., Wilmington, DE (US)

( * ) Notice: Subject to any disclaimer, the term of this patent is extended or adjusted under 35 U.S.C. 154(b) by 103 days.

(21) Appl. No.: 14/429,118

(22) PCT Filed: Sep. 18, 2013

(86) PCT No.: PCT/US2013/060363
§ 371 (c)(1),
(2) Date: Mar. 18, 2015

(87) PCT Pub. No.: WO2014/047149
PCT Pub. Date: Mar. 27, 2014

(65) Prior Publication Data

US 2015/0233052 A1 Aug. 20, 2015

Related U.S. Application Data

(60) Provisional application No. 61/703,171, filed on Sep. 19, 2012.

(51) Int. Cl.

| | |
|---|---|
| ***D06P 3/28*** | (2006.01) |
| ***D06P 3/56*** | (2006.01) |
| ***D06P 3/38*** | (2006.01) |

(52) U.S. Cl.
CPC ..... *D06P 3/28* (2013.01); *D06P 3/38* (2013.01); *D06P 3/56* (2013.01)

(58) Field of Classification Search
CPC ..... D06P 3/28; D06P 3/56; D06P 3/38
See application file for complete search history.

(56) References Cited

U.S. PATENT DOCUMENTS

| | | | | | |
|---|---|---|---|---|---|
| 3,906,757 | A * | 9/1975 | Arimoto | D06B 1/08 | 118/410 |
| 4,095,558 | A * | 6/1978 | Ellegast | D06B 1/08 | 118/420 |
| 5,339,658 | A * | 8/1994 | Haselwander | D06B 11/0026 | 101/172 |
| 5,520,962 | A * | 5/1996 | Jones, Jr. | D06M 15/263 | 427/393.4 |
| 5,853,814 | A | 12/1998 | Murphy | | |
| 5,948,480 | A | 9/1999 | Murphy | | |
| 6,197,378 | B1 | 3/2001 | Clark et al. | | |
| 6,472,019 | B1 * | 10/2002 | Yamaguchi | D06M 13/262 | 427/354 |
| 2009/0032492 | A1 | 2/2009 | Kunze-Concewitz | | |

FOREIGN PATENT DOCUMENTS

| | | | |
|---|---|---|---|
| EP | 0634513 | A1 | 1/1995 |
| EP | 0756032 | A1 | 1/1997 |
| EP | 1024219 | * | 8/2000 |
| EP | 1024219 | A1 | 8/2000 |
| JP | 2008-149259 | A | 7/2008 |
| WO | 00/00691 | A1 | 1/2000 |
| WO | 2014/047149 | A1 | 3/2014 |

OTHER PUBLICATIONS

International Preliminary Report on Patentability received for PCT Patent Application No. PCT/US2013/060363, dated Apr. 2, 2015, 9 pages.
International Search Report and Written Opinion received for PCT Patent Application No. PCT/US2013/060363, dated Dec. 30, 2013, 11 pages.

* cited by examiner

*Primary Examiner* — Amina S Khan
(74) *Attorney, Agent, or Firm* — Robert B. Furr, Jr.

(57) ABSTRACT

Disclosed are processes for application of dyes and topical chemistries to single yarns during a yarn rewind process. The process foregoes the need for downstream environmentally unfavorable dyeing and low PH chemical treatment processes on the finished carpet. Further, neutral pH dye solutions can be used instead of the prior art low pH dye solutions. The single, treated yarn can then be twisted, weaved and tufted, twisted yarn under dry conditions, and the twisted yarn subsequently weaved or weaved and tufted, into a finished fabric or carpet. Also disclosed are systems, BCF yarns, and carpets made from the BCF yarn treated by the disclosed processes.

24 Claims, No Drawings

APPARATUS AND METHOD FOR APPLYING COLORS AND PERFORMANCE CHEMICALS ON CARPET YARNS

FIELD OF THE INVENTION

The invention relates to treatment application processes for bulked continuous filament (BCF) carpet and related textile fabrics, and specifically, to processes for applying dyes and topical treatments such as dyes and performance enhancing (i.e., anti-soil and/or anti-stain) compositions on BCF yarns prior to weaving, knitting or tufting. The process foregoes the need to dye and otherwise treat carpets and other textiles made from the BCF yarn Thus, low inventory overhead is achieved and costly and environmentally unfavorable dyeing and low pH chemical treatment processes are eliminated. Also disclosed herein are systems used to apply the dye and performance enhancement compositions to the BCF yarn, and stain/soil repellent yarns, and carpets with improved anti-stain and anti-soil properties made from the BCF yarn of the disclosed process.

BACKGROUND OF THE TECHNOLOGY

Carpets and other fabrics made from synthetic yarns are currently colored using two well-established processes. The first process involves converting colorless white yarns into carpet, and dyeing the carpet in a dye bath. This process is referred to as the "acid dye process." The acid dye process can be either a batch or a continuous dyeing operation. Each dyeing operation requires a large volume of water, steam to set the dyes, and heat to dry the carpet. In addition, collection and disposal of excess dye and acidified performance enhancing solutions add manufacturing cost and place additional burden on waste management and water treatment facilities. The second process adds color pigments into the polymer during the melt spinning process. This process is referred to as the "solution dye process." The solution dye process is a low cost operation, but in comparison to the acid dye process it imposes undesirable inventory allocation measures on the fiber producer and the carpet mill. In order to meet consumer demand, then, the fiber producer and carpet mill may need to keep a costly inventory of colored yarns produced by the solution dye process. Variable production demands and large inventory costs can affect inventory flexibility with the result being the color availability of solution dyed carpets is undesirably limited.

Carpets and other fabrics are currently treated with topical chemistries for improved stain resistance and/or soil resistance. For nylon carpets, both stain blocker (e.g. acid dye blocker) and anti-soil with fluorochemicals are traditionally used. For polyester carpets, such as polyethylene terephthalate (2GT) and polytrimethylene terephthalate (3GT) carpets, and polypropylene carpets, anti-soil chemistry may be applied topically to the tufted carpet as part of the carpet finishing process. Polyester and polypropylene carpets typically do not require a stain blocker treatment because of inherent stain resistance to acid dyes and stains owing to their lack of amine end groups that function as acid dye sites.

Topical application at the carpet mill can be in the form of exhaust application and spray application. Exhaust application (i.e. flex-nip process at high (300-400 wt. %) wet pick-up), is known to provide an improvement in efficacy over spray-on applications at 10-20 wt. % wet pick-up of anti-soil. Exhaust applications typically use higher amounts of water and energy to dry and cure the carpet than do spray applications. Spray-on fluorochemical products are designed to use less water and energy than exhaust applications, but do not impart satisfactory anti-soil properties.

While various processes are in use in the carpet industry for the dyeing and finishing of carpets, some large scale and some small, most of the carpet made today is dyed and finished on a continuous dye range. This is done mainly in one of two ways: In one case, a two stage process is employed, where the carpet is steamed and dyed first, steamed, rinsed, and excess water extracted; then stain blocker (SB) is applied, the carpet is again steamed and washed, and then anti-soil fluorochemical (FC) is applied in the form of a foam or liquid spray and the carpet is finally dried. (See e.g. U.S. Pat. Nos. 5,853,814; 5,948,480 and WO2000/000691). In the second, somewhat improved case, called the co-application process, the carpet is also steamed and dyed first, steamed again, rinsed and extracted; and then a blend of SB and FC is applied together at high wet pick up, after which the carpet and chemicals are exposed once again to steam to fix the treatment, followed by drying. (See e.g. U.S. Pat. Nos. 6,197,378 and 5,520,962). In both cases, low pH solutions, excess water, and energy are required for the SB and FC to penetrate the carpet and achieve uniform coverage. In sum, the typical process is as follows: BCF yarn→Twist→heat set→tufting→carpet→dye→stain block/anti-soil.

SUMMARY OF THE INVENTION

There is a desire to reduce the overall usage of dyeing solutions, stain blocker and topical anti-soil formulations, especially formulations that contain fluorochemicals, for environmental and cost reasons. Further, there is also a desire to reduce the amount of water and low pH chemicals used to apply the dyeing, anti-stain and/or anti-soil compositions. Thus, processes for applying such beneficial compositions using less water, nominal pH chemicals, and less energy are in demand.

While the development of a process that eliminates the current carpet treatment systems for applying anti-stain and anti-soil compositions is desirable, current processes do exist for good reasons. First, because the appearance of carpet has historically depended on the ability to dye wool or nylon or even polyester tufted carpets to the desired shade, it would not be permissible to treat the carpet with compositions such as anti-stain or anti-soil chemistries beforehand that might interfere with the process of uniform dyeing. Further, the dyeing process would tend to remove the topical treatment chemistries, rendering them ineffective.

Second, as mentioned above, treatment of yarn or fabric with performance enhancement formulations such as those for stain and soil resistance typically involves fixing with steam, and low pH may also be required especially for acid dyed fabrics. Therefore, it was deemed most practical to process carpets in the order described above, where carpet is formed, then steamed and dyed, steamed again, rinsed and extracted; and then SB and FC is applied, again involving steaming and/or rinsing in the various well-known processes.

Carpets have also long been constructed of dyed or pigmented yarns, which constructions are treated in numerous possible ways, including the options of further dyeing, and the application of stain and/or soil resistant compositions with the concomitant use of steam and rinse water, as in the processes described above.

Aspects disclose herein provide a process to make textile fabrics, especially tufted articles, without the requirement for dyeing and subsequent stain and soil resistant chemistry application, thus avoiding the costs associated with maintaining large inventories as well as waste generated by steam fixing and rinsing attendant with such large-scale fabric applications.

As disclosed herein, one process involves application of dyes and topical chemistries to single yarns during a yarn rewind process dyed or pigmented yarns immediately after twisting or cabling one or more such yarns together. The chemistries are then optionally heat-set onto the single yarn. The single, treated yarn can then be twisted, weaved and tufted, twisted yarn under dry conditions, and the twisted yarn subsequently weaved or weaved and tufted, into a finished fabric or carpet. Novel systems that enable the efficient application of dye solutions and topical chemistries to yarn subsequent to twisting and prior to winding and heat-setting are also disclosed.

Specifically, the disclosed process uses a dye solution or topical chemistry composition applicator positioned within a mechanical twisting process downstream of the twisted yarn take-up reel and upstream of the yarn winder. In sum, the disclosed process moves the back end, large scale and wasteful stain blocker application step up front during or after yarn twisting. Thus, the carpet manufacturing process now becomes: BCF yarn→twist→dye→optional SB/FC→heat set (optionally dry heat set)→tufting→carpet. Surprisingly, the disclosed process is as effective, or even more effective, than processes of the prior art in terms of fabric soil resistance. Additionally, neutral pH dye solutions (4-7.5 pH) can be used instead of the prior art low pH dye solutions (1-3 pH). This reduces the environmental impact of prior art processes. Moreover, the need for a stain blocker application is not necessary due to the inclusion of a cationic dyeable polyamide or polyester. In other words, the stain blocker application can be consciously excluded while not sacrificing stain resistant properties.

As described above, the process of the disclosed invention is counterintuitive since treating the carpet yarn prior to heat setting and tufting is known to affect the quality of the finished carpet, particularly during dyeing. Further, the inventive process is also counterintuitive because soil resistant compositions tend to be very difficult to apply uniformly to twisted yarn bundles at the usual line speed without substantial waste [30 to 80 yards-per-minute (ypm)]. Moreover, the disclosed process is counter intuitive because yarn rewind-twisting apparatuses have not previously accepted topical chemistry applications to single or twisted yarn prior to winding or rewinding. However, as shown below, nylon and polyester carpets manufactured with the treated BCF yarn show one or more of the following desirable characteristics: superior anti-soil properties over the same carpets without such treatment.

At least equivalent dyeing characteristics vs. the current state of the art processes.

At least equivalent stain and soil repellant performance vs. the current state of the art processes.

Desirable aesthetic attributes otherwise not generated by the current state of the art processes.

In one aspect is a process for applying a treatment to a single or twisted BCF yarn comprising:

a. providing a single or twisted BCF yarn;

b. winding said yarn on a take up reel;

c. providing at least one rotating roll including a plurality of wicks for providing a treatment;

d. contacting said wicks with said treatment;

e. contacting said BCF yarn with said wicks; and f. heat setting said BCF yarn.

In one aspect, a process for treating twisted or single BCF yarn with one or more dye compositions or treatment compositions is disclosed. The process comprises: (a) providing twisted or single BCF yarn; (b) winding said BCF yarn on a take-up reel or rewind package; and (c) contacting said BCF yarn with said dye composition or treatment composition while said BCF yarn is in motion and prior to said BCF yarn contacting and winding up on said take-up reel or rewind package. The dye composition can be comprised of an acid dye composition or a disperse dye composition.

In another aspect, a process for treating twisted or single BCF yarn with one or more dye compositions or treatment compositions is disclosed. The process comprises: (a) providing twisted or single BCF yarn; (b) winding said BCF yarn on a rewind package; (c) contacting said BCF yarn with said dye composition while said BCF yarn is in motion; and prior to said BCF yarn contacting and winding up on said rewind package; and (d) heat setting said BCF yarn after contacting said BCF yarn with said dye composition and prior to winding up on said rewind package. The dye composition can be comprised of an acid dye composition or a disperse dye composition.

The invention disclosed herein provides a process to make textile fabrics, especially tufted articles, without the requirements for dyeing and subsequent stain and soil resistant chemistry application, thus avoiding the costs associated with maintaining large inventories as well as waste generated by steam fixation and rinsing attendant with such large-scale fabric applications. As disclosed herein, the process involves application of dyes and topical chemistries to undyed single yarns during a yarn rewind process. The chemistries are then optionally heat-set onto the single yarn. The single, treated yarn can then be twisted, weaved and tufted, or weaved and tufted, into a finished fabric or carpet. Novel systems that enable the efficient application of dye solutions and topical chemistries to yarn subsequent to twisting and prior to winding and heat-setting are also disclosed.

Specifically, the disclosed process uses a dye solution and/or performance enhancing composition applicator positioned within a mechanical rewind process. In sum, the disclosed process moves the back end, large scale and wasteful stain blocker application step to a single yarn rewind process. Thus, the carpet manufacturing process now becomes: BCF yarn→dye→optional SB/FC→optional heat set→optional twist→heat set (optionally dry heat set)→tufting→carpet. Surprisingly, the disclosed process is as effective, or even more effective, than processes of the prior art in terms of fabric soil resistance. Additionally, neutral pH dye solutions (4-9 pH) can be used instead of the prior art low pH dye solutions (1-3 pH). This reduces the environmental impact of prior art processes.

As described above, the process of the disclosed invention is counterintuitive since treating the carpet yarn prior to heat setting and tufting is known to affect the quality of the finished carpet, particularly during dyeing. Further, the inventive process is also counter intuitive because soil resistant compositions tend to be very difficult to apply uniformly to twisted yarn bundles at the usual line speed without substantial waste [30 to 80 yards-per-minute (ypm)]. Moreover, the disclosed process is counter intuitive because the prior art yarn rewind apparatuses have not previously accepted topical chemistry applications to single yarn prior to rewinding. However, as shown below, nylon and polyester carpets manufactured with the treated BCF yarn show one or more of the following desirable characteristics:

At least equivalent dyeing characteristics vs. the current state of the art processes.

At least equivalent stain and soil repellant performance vs. the current state of the art processes.

Desirable aesthetic attributes otherwise not generated by the current state of the art processes.

In one aspect, a process for treating single BCF yarn with a dye composition is disclosed. The process comprises: (a) providing single BCF yarn; (b) winding said BCF yarn on a rewind package; and (c) contacting said BCF yarn with said dye composition while said BCF yarn is in motion and prior to said BCF yarn contacting and winding up on said rewind package. The dye composition can be comprised of an acid dye composition or a disperse dye composition.

In another aspect, a process for treating single BCF yarn with a dye composition is disclosed. The process comprises: (a) providing single BCF yarn; (b) winding said BCF yarn on a rewind package; (c) contacting said BCF yarn with said dye composition while said BCF yarn is in motion and prior to said BCF yarn contacting and winding up on said rewind package; and (d) heat setting said BCF yarn after contacting with said dye composition and prior to winding up on said rewind package. The dye composition can be comprised of an acid dye composition or a disperse dye composition.

In a further aspect, a process for treating single BCF yarn with a dye composition and at least one performance enhancing compositions is disclosed. The process comprises: (a) providing single BCF yarn; (b) winding said BCF yarn on a rewind package; (c) contacting said BCF yarn with said dye composition; (d) optionally contacting said BCF yarn with a first performance enhancing composition; and (e) contacting said BCF yarn with a second performance enhancing composition prior to said BCF yarn contacting and winding up on said rewind package, wherein said BCF yarn is in motion while contacted with said dye, said optional first performance enhancing composition, and said second performance enhancing composition. The dye composition can be comprised of an acid dye composition or a disperse dye composition. The optional first performance enhancing composition can be stain blocking compositions that are comprised of species having acidic moieties that associate with polymer amine end groups and protect them from staining by acidic dye stains. The general category of chemicals suitable to the process of the instant invention can comprise any chemical that blocks positively charged dye sites. The second performance enhancing composition can be anti-soil compositions that comprise high specific surface energy chemicals or other materials, for example a fluorochemical that imparts high specific surface energy properties such as high contact angles for water and oil, or even a non-fluorochemical particulate material having similar properties. The anti-soil composition can further comprise an anti-stain component.

In even another aspect, a process for treating single BCF yarn with a dye composition and performance enhancing compositions is disclosed. The process comprises: (a) providing single BCF yarn; (b) winding said BCF yarn on a rewind package; (c) contacting said BCF yarn with said dye composition; (d) optionally contacting said BCF yarn with a first performance enhancing composition; (e) contacting said BCF yarn with a second performance enhancing composition, wherein said BCF yarn is in motion while contacted with said dye, said first performance enhancing composition, and said second performance enhancing composition; and (f) heat setting said BCF yarn after contacting said BCF yarn with said dye composition, said first performance enhancing composition, and said second performance enhancing composition and prior to winding on said rewind package. The dye compositions and performance enhancing compositions are disclosed above.

In a further aspect, an untufted, single BCF yarn comprising a dye component is disclosed, wherein said dye component is present on said single BCF yarn prior to tufting the BCF yarn. The dye component is selected from acid and disperse dye ingredients. The yarn can comprise polyamide fiber and/or have polymer components selected from polyester. The yarn can be tufted and manufactured into carpet or fabrics.

In yet another aspect, an untufted, single BCF yarn comprising a dye component, an anti-soil component, and an optional anti-stain component is disclosed, wherein said dyeing component, anti-soil component and optional anti-stain component are present on said single BCF yarn prior to tufting the BCF yarn. The dye component is selected from acid and disperse dye ingredients. The anti-soil component and optional anti-stain component can be selected from the compositions disclosed above. The stain blocking component is optionally present at an amount on weight of fiber of about 0.5 to about 40 ppm elemental sulfur content. The anti-soil component is present at an amount on weight of fiber from about 100 ppm to about 1000 ppm elemental fluorine content. The yarn can comprise polyamide fiber and/or have polymer components selected from polyester. The yarn can be tufted and manufactured into carpet or fabrics.

In yet a further aspect, a process for manufacturing carpet is disclosed comprising providing an untufted, single BCF yarn comprising a dye component, an optional stain blocker component, and an anti-soil component, tufting said BCF yarn, and weaving into said carpet. Because of the dye and performance enhancing components present on the BCF yarn prior to tufting and weaving, there is no need to process the finished carpet by dyeing or treating with an acidified stain blocker composition and an anti-soil composition under the current state of the art processes.

In yet even another aspect, a system for applying a dye composition to single BCF yarn is disclosed. The system comprises: (a) a yarn package that transmits a single yarn member; (b) a dye composition applicator disposed downstream of said yarn package that applies said dye composition to said single yarn member; and (c) a rewind package that receives a dyed single yarn member. The dyeing composition can be comprised of acid dye or disperse dye ingredients.

In yet even a further aspect, a system for applying a dye composition and at least one performance enhancing composition to single BCF yarn is disclosed. The system comprises: (a) a yarn package that transmits a single yarn member; (b) a dye composition applicator disposed downstream of said yarn package that applies said dye composition to said single yarn member; (c) an optional first performance enhancing composition applicator disposed downstream of said dye composition applicator that applies said first performance enhancing composition to said single yarn member; (d) second performance enhancing composition applicator disposed downstream of said dye composition applicator that applies said second performance enhancing composition to said single yarn member; and (e) a rewind package disposed downstream of said performance enhancing composition applicator that receives a dyed single yarn member. The dyeing composition can be comprised of acid dye or disperse dye ingredients. The optional first performance enhancing composition can comprise anti-stain compositions having species having acidic moieties that associate with polymer amine end groups and protect them from staining by acidic dye stains. The second performance enhancing composition can comprise anti-soil compositions of a high specific surface energy chemical or other material, for example a fluorochemical that imparts high specific surface energy properties such as high contact angles for water and oil, or even a non-fluorochemical particulate material having similar properties. The anti-soil composition can further comprise an anti-stain component.

In one aspect, a process for treating twisted BCF yarn with one or more dye compositions is disclosed. The process comprises: (a) providing twisted BCF yarn; (b) winding said BCF yarn on a take-up reel; and (c) contacting said BCF yarn with said dye composition while said BCF yarn is in motion and prior to said BCF yarn contacting and winding up on said take-up reel. The dye composition can be comprised of an acid dye composition or a disperse dye composition.

In another aspect, a process for treating twisted BCF yarn with one or more dye compositions is disclosed. The process comprises: (a) providing twisted BCF yarn; (b) contacting said BCF yarn with said dye composition while said BCF yarn is in motion; and (c) heat setting said BCF yarn after contacting said BCF yarn with said dye composition. The dye composition can be comprised of an acid dye composition or a disperse dye composition.

In a further aspect, a process for treating twisted BCF yarn with one or more dye compositions and performance enhancing compositions is disclosed. The process comprises: (a) providing twisted BCF yarn; (b) winding said BCF yarn on a take-up reel; (c) contacting said BCF yarn with said dye composition; (d) optionally contacting said BCF yarn with a first performance enhancing composition comprising a stain blocking composition; and (e) contacting said BCF yarn with a second performance enhancing composition comprising an anti-soil composition and prior to said BCF yarn contacting and winding up on said take-up reel, wherein said BCF yarn is in motion while contacted with said dye, said optional first performance enhancing composition, and said second performance enhancing composition. The dye composition can be comprised of an acid dye composition or a disperse dye composition. The stain blocking composition can be comprised of species having acidic moieties that associate with polymer amine end groups and protect them from staining by acidic dye stains. The general category of chemicals suitable to the process of the instant invention can comprise any chemical that blocks positively charged dye sites. The anti-soil composition can be comprised of a high specific surface energy chemical or other material, for example a fluorochemical that imparts high specific surface energy properties such as high contact angles for water and oil, or even a non-fluorochemical particulate material having similar properties. The anti-soil composition can further comprise an anti-stain component.

In even another aspect, a process for treating twisted BCF yarn with one or more dye compositions and performance enhancing compositions is disclosed. The process comprises: (a) providing twisted BCF yarn; (b) contacting said BCF yarn with said dye composition; (c) optionally contacting said BCF yarn with a first performance enhancing composition comprising a stain blocking composition; (d) contacting said BCF yarn with a second performance enhancing composition comprising an anti-soil composition, wherein said BCF yarn is in motion while contacted with said dye, said optional first performance enhancing composition, and said second performance enhancing composition and; (e) heat setting said BCF yarn after contacting said BCF yarn with said dye composition, said optional first performance enhancing composition, and said second performance enhancing composition. The dye compositions and performance enhancing compositions are disclosed above.

In a further aspect, an untufted, twisted BCF yarn comprising a dye component is disclosed, wherein said dye component is present on said twisted BCF yarn prior to tufting the BCF yarn. The dye component is selected from acid and disperse dye ingredients. The yarn can comprise polyamide fiber and/or have polymer components selected from polyester. The yarn can be tufted and manufactured into carpet or fabrics.

In yet another aspect, an untufted, twisted BCF yarn comprising a dye component, an anti-soil component, and an optional anti-stain component is disclosed, wherein said dyeing component, anti-soil component and optional anti-stain component are present on said twisted BCF yarn prior to tufting the BCF yarn. The dye component is selected from acid and disperse dye ingredients. The anti-soil component and optional anti-stain component can be selected from the compositions disclosed above. The stain blocking component is optionally present at an amount on weight of fiber of about 0.5 to about 40 ppm elemental sulfur content. The anti-soil component is present at an amount on weight of fiber from about 100 ppm to about 1000 ppm elemental fluorine content. The yarn can comprise polyamide fiber and/or have polymer components selected from polyester. The yarn can be tufted and manufactured into carpet or fabrics.

In yet a further aspect, a process for manufacturing carpet is disclosed comprising providing an untufted, twisted BCF yarn comprising a dye component, an optional stain blocker component, and an anti-soil component, tufting said BCF yarn, and weaving into said carpet. Because of the dye and performance enhancing components present on the BCF yarn prior to tufting and weaving, there is no need to process the finished carpet by dyeing or treating with an acidified stain blocker composition and an anti-soil composition under the current state of the art processes.

In yet even another aspect, a system for applying a dye composition to twisted BCF fiber is disclosed. The system comprises: (a) a first yarn take-up device that transmits a single yarn member made from at least two individual yarn members; (b) a dye composition applicator disposed downstream of said yarn take-up device that applies said dye composition to said single yarn member; and (c) a second yarn take-up device that receives a dyed single yarn member. The dyeing composition can be comprised of acid dye or disperse dye ingredients.

In yet even a further aspect, a system for applying a dye composition and at least one performance enhancing composition to twisted BCF fiber is disclosed. The system comprises: (a) a first yarn take-up device that transmits a single yarn member made from at least two individual yarn members; (b) a dye composition applicator disposed downstream of said yarn take-up device that applies said dye composition to said single yarn member; (c) an optional anti-stain component applicator disposed downstream of said dye composition applicator that applies anti-stain composition to said single yarn member; (d) an anti-soil applicator disposed downstream of said dye composition applicator that applies anti-soil composition to said single yarn member; and (d) a second yarn take-up device that receives a dyed single yarn member. The dyeing composition can be comprised of acid dye or disperse dye ingredients. The anti-stain composition can be comprised of species having acidic moieties which associate with polymer amine end groups and protect them from staining by acidic dye stains. The anti-soil composition can be comprised of a high specific surface energy chemical or other material, for example a fluorochemical that imparts high specific surface energy properties such as high contact angles for water and oil, or even a non-fluorochemical particulate material having similar properties. The anti-soil composition can further comprise an anti-stain component.

As describe above, the process of the disclosed invention is counter intuitive since treating the carpet yarn prior to heat setting and tufting is known to affect the quality of the finished carpet, particularly during dyeing. Further, the inventive process is also counterintuitive because soil resistant compositions tend to be very difficult to apply uniformly to twisted yarn bundles at the usual line speed without substantial waste. Moreover, the disclosed process is counter intuitive because yarn-twisting apparatuses have not previously accepted topical chemistry applications to twisted yarn prior to winding. However, as shown below, nylon carpets manufactured with the treated BCF yarn show superior anti-soil properties over the same carpets without such treatment.

In one aspect, a process for treating twisted BCF yarn with an anti-soil composition comprising an anti-soil component is disclosed. The process comprises: (a) providing twisted BCF yarn; (b) contacting said BCF yarn with said anti-soil composition while said BCF yarn is in motion; and (c) dry heat setting said BCF yarn. The anti-soil composition can be comprised of a high specific surface energy chemical or other material, for example a fluorochemical, that imparts high specific surface energy properties such as high contact angles for water and oil, or even a non-fluorochemical particulate material having similar properties. The anti-soil composition can further comprise an anti-stain component.

In yet another aspect, a system for applying an anti-soil composition to twisted BCF fiber is disclosed. The system comprises: (a) a first yarn take-up device that transmits a single yarn member made from at least two individual yarn members; (b) an anti-soil composition applicator disposed downstream of said yarn take-up device that applies said anti-soil composition to said single yarn member; (c) a yarn dry heat setting apparatus disposed downstream from said anti-soil composition applicator; and (d) a second yarn take-up device that receives said single yarn member. The anti-soil composition can be comprised of a high specific surface energy chemical or other material, for example a fluorochemical that imparts high specific surface energy properties such as high contact angles for water and oil, or even a non-fluorochemical particulate material having similar properties. The anti-soil composition can further comprise an anti-stain component.

Definitions

While mostly familiar to those versed in the art, the following definitions are provided in the interest of clarity.

OWF (On weight of fiber): The amount of chemistry that was applied as a % of weight of fiber.

WPU (Wet pick-up): The amount of water and solvent that was applied on carpet before drying off the carpet, expressed as a % of weight of fiber.

DETAILED DESCRIPTION OF THE INVENTION

A process for treating single BCF or twisted bulked continuous filament (BCF) yarn is disclosed comprising contacting the BCF yarn with a dye and/or chemical treatment composition while said yarn is in motion and prior to contacting and winding or rewinding the yarn into a yarn package or cake. The process can also include contacting the BCF yarn with one or more performance enhancing compositions comprising stain blockers and anti-soil compositions.

Bulked continuous filament (BCF) yarn is distinguished from other textile yarns by a high level of three-dimensional crimp, such as that which may be achieved through the use of a bulking jet or a stuffer box. The crimp makes BCF especially well-suited for use as a carpet yarn. However, the bulk makes the application of dyes or other chemical treatments to the fibers within the yarn more challenging compared to non-crimped yarn.

A process for treating twisted BCF yarn is disclosed comprising contacting the BCF yarn with a dye or treatment composition while said yarn is in motion and prior to contacting and winding the yarn onto a take-up reel or winder to create a yarn package or cake. The process can also or alternatively include contacting the BCF yarn with one or more performance enhancing compositions comprising stain blockers and anti-soil compositions.

The dye or treatment composition component and is adapted to be continuously applied onto twisted BCF yarn at about 10 to about 100 upm, including from about 30 to about 80 ypm. The stain blocker composition comprises an anti-stain component and is adapted to be continuously applied onto single or twisted BCF yarn at a wet pick-up of 10 to 50%, preferably 15 to 30%. The anti-soil composition comprises an anti-soil component and is adapted to be continuously applied onto single or twisted BCF yarn at a wet pick-up of between about 5 wt. % and about 50 wt. %., including between about 10 wt. % and about 30 wt %, about 20 wt. % to about 30 wt. %, and about 10 wt. % to about 20 wt. %. The single or twisted BCF yarn can be optionally heat set and also be texturized, after contacting the yarn with the dye and or performance enhancing treatment composition and the one or more performance enhancing composition prior to heat setting. Heat setting temperatures can range from about 125° C. to about 200° C., including from about 160° C. to about 195° C. Heat setting dwell times can range from about 0.5 to about 4 minutes, including from about 0.5 to about 3 minute and from about 0.5 to about 1 minute.

Dye components for use in the disclosed dye compositions are acid dyes or disperse dyes. Acid dye components are well known to those skilled in the art and are water-soluble ionic species containing one or more organic chromophore moieties. Acid dyes are typically provided in powder form and different acid dyes can be used in combinations to arrive at a precisely defined color choice depending on process conditions such as the use rate of each selected dye component, the use rate of the one or more acid auxiliaries employed, and the residence time of the substrate in the dyeing zone. Examples of suitable acid dye compositions are Orange 3G, Red 2B and Blue 4R. Disperse dye components are likewise well known to those skilled in the art and are water-insoluble nonionic species containing one or more organic chromophore moieties. Disperse dyes are either provided in paste form in combination with a dispersing agent or in powder form. Different disperse dyes can be used in combinations to arrive at a precisely defined color choice depending on process conditions such as the use rate of each selected disperse dye component, the specific dispersing agent or agents employed, and the residence time of the substrate in the dyeing zone. Examples of suitable disperse dye compositions are Disperse Red 60, Disperse Yellow 86 and Disperse Violet 33.

Anti-stain components for use in the disclosed stain blocker compositions have a component bearing an acidic moiety which associates with polymer amine end groups and protects them from staining by acidic dye stains. The general category of chemicals suitable to the process of the instant invention can comprise any chemical that blocks positively charged dye sites. Stain blockers are available in various forms such as syntans, sulfonated novolacs, sulfonated aromatic aldehyde condensation products (SACs) and/or reaction products of formaldehyde, phenolics, substituted phenolics, thiophenolics, sulfones, substituted sulfones, polymers or copolymers of olefins, branched olefins, cyclic olefins, sulfonated olefins, acrylates, methacrylates, maleic anyhydride, and organosulfonic acids. They are usually made by reacting formaldehyde, phenol, polymethacrylic acid, maleic anyhydride, and sulfonic acid depending on specific chemistry. Further, the stain blocker is typically water soluble and generally penetrates the fiber while the anti-soil, usually a fluorochemical, is a non-water soluble dispersion that coats the surface of fiber. More than one stain blocker can be used in the anti-stain compositions.

Examples of stain blockers include, but are not limited to: phenol formaldehyde polymers or copolymers such as CEASESTAIN and STAINAWAY (from American Emulsions Company, Inc., Dalton, Ga.), MESITOL (from Bayer Corporation, Rock Hill, N.C.), ERIONAL (from Ciba Corporation, Greensboro, N.C.), INTRATEX (from Crompton & Knowles Colors, Inc., Charlotte, N.C.), STAINKLEER (from Dyetech, Inc., Dalton, Ga.), LANOSTAIN (from Lenmar Chemical Corporation, Dalton, Ga.), and SR-300, SR-400, and SR-500 (from E. I. du Pont de Nemours and Company, Wilmington, Del.); polymers of methacrylic acid such as the SCOTCHGARD FX series carpet protectors (from 3M Company, St. Paul Minn.); sulfonated fatty acids from Rockland React-Rite, Inc., Rockmart, Ga.); and stain resist chemistries from ArrowStar LLC, Dalton and Tri-Tex, Canada.

Anti-soil components for use in the disclosed anti-soil compositions impart high specific surface energy properties such as high contact angles for water and oil (e.g. water and oil "beads up" on surfaces treated by it). The anti-soil component can comprise a fluorochemical dispersion, which dispersion may be predominantly either cationic or anionic, including those selected from the group consisting of fluorochemical allophanates, fluorochemical polyacrylates, fluorochemical urethanes, fluorochemical carbodiimides, fluorochemical guanidines, non-telomeric fluorochemicals, and fluorochemicals incorporating C2 to C8 chemistries. Alternatively, the fluorochemical can have one or more monomeric repeat units having less than or equal to eight fluorinated carbons, including less than or equal to six fluorinated carbons. Example fluorochemical anti-soil components include: DuPont TLF 10816 and 10894; Daikin TG 2511, and DuPont™ Capstone® RCP. Non-fluorinated anti-soil components can include: silicones, silsesquioxanes and silane-modified particulates, organosilane-modified particulates and alkylated particulates, anionic non-fluorinated surfactants and anionic hydrotrope non-fluorinated surfactants, including sulfonates, sulfates, phosphates and carboxylates. (See U.S. Pat. No. 6,824,854, herein incorporated by reference). More than one anti-soil components can be used in the anti-soil compositions.

The dye composition is adapted to contact the twisted or single BCF yarn while it is in motion and prior to contacting the take-up reel or winder. Further, the dye composition can be at a neutral pH (e.g. 4 to 9, including 5.5 to 7.5) because the yarn can be optionally heat set after application of the composition. The process foregoes the need for harsh low pH chemicals; deionized water is suitable for use in the disclosed process.

The stain blocker composition is adapted to contact the twisted or single BCF yarn while it is in motion and prior to contacting the take-up reel or winder. Further, the stain blocker composition can be at a neutral pH (e.g. 6 to 8) because the yarn can be optionally heat set after application of the composition. The process foregoes the need for harsh low pH chemicals.

The anti-soil compositions can also have an optional stain blocker component comprising an acidic moiety that associates with polymer amine end groups and protects them from staining by acidic dye stains. The general category of chemicals suitable to the process of the invention can comprise any chemical that blocks positively charged dye sites. Stain blockers are available in various forms such as syntans, sulfonated novolacs, sulfonated aromatic aldehyde condensation products (SACs) and/or reaction products of formaldehyde, phenolics, substituted phenolics, thiophenolics, sulfones, substituted sulfones, polymers or copolymers of olefins, branched olefins, cyclic olefins, sulfonated olefins, acrylates, methacrylates, maleic anhydride, and organosulfonic acids. They are usually made by reacting formaldehyde, phenol, acrylic acid, methacrylic acid, itaconic acid, maleic anhydride, and organosulfonic acid depending on specific chemistry. Further, the stain blocker is typically water soluble and generally penetrates the fiber while the anti-soil, usually a fluorochemical, is a non-water soluble dispersion that coats the surface of fiber. The stain blocker can also be applied subsequent to the anti-soil using a separate applicator.

Examples of stain blockers include, but are not limited to: phenol formaldehyde polymers or copolymers such as Barshield K-9 (from Apollo Chemical Co., Graham, N.C.), RM (from Peach State Labs, Rome, Ga.), FX-369 (from 3M Company, St. Paul, Minn.) and Zelan 8236, (from E. I. du Pont de Nemours and Company, Wilmington, Del.); polymers and copolymers of methacrylic acid such as FX-657 and FX-661 (from 3M Company, St. Paul, Minn.); polymers and copolymers of maleic anhydride such as SR-500 (from E. I. du Pont de Nemours and Company, Wilmington, Del.); and stain resist chemistries from ArrowStar LLC (Dalton, Ga.), TANATEX Chemicals (Dalton, Ga.) and Tri-Tex Co., Inc. (Saint-Eustache, Qc, Canada).

Common stain blockers use sulfonated moieties as part of the chemistry, which results in the presence of sulfur on the treated fiber. The sulfur content can range from about 50 ppm with 5% stain blocker to about 1 ppm with 0.1% stain blocker on weight of fiber. Thus, based on the above stain blocker concentrations, the sulfur content on weight of fiber will range from about 0.5 ppm to about 40 ppm, including from about 1 ppm to about 30 ppm, from about 5 ppm to about 20 ppm, and from about 5 ppm to about 10 ppm. Sulfur content can be determined by x-ray diffraction or other methods.

The dye, treatment or anti-soil composition is adapted to contact the twisted BCF yarn while it is in motion and prior to contacting the take-up reel or heat setting. Further, the anti-soil composition can be at a neutral pH (e.g. 6 to 8) because the yarn can be optionally heat set after application of the composition. The process foregoes the need for harsh low pH chemicals.

The contacting can be performed by any suitable device that applies wet ingredients to a dry substrate, including, but not limited to: applicator pad, nip rollers, wet-wick, dip-tank, sprayer, and mister.

For example, cotton wicks can be stacked together to form the desired thickness (e.g. ½"-3") and submersed in the dye bath for transporting dye solution to the moving yarn at a constant flow-rate. The wick thickness selection was based on the optimum wick and yarn contacting time needed to achieve the desired color depth and color consistency. A further option is to use multiple sets of wicking applicator stations. The first wicking applicator station applies the primary color onto the yarn and the second wicking applicator station applies a second color or performance enhancing chemical onto the yarn. Each wicking applicator station can be made up of one or more wicks.

Another option is to transport dye solution or other treatment to the yarn using one, two or more rotating rolls covered with wicks. Here, the yarn passes between the two rotating rolls. May contact one roll or pass between two or more rotating rolls. The wicks on the surface of the rolls may be supplied with the treatment by one or more radially oriented capillaries extending from the inside to the outer surface of the cylindrical roll. The wicks may be located in a portion of of the surface or be distributed evenly throughout the surface. Where treatment to a localized portion of the yarn length is desired, a roll with a portion of wicks will be selected (meaning that there are sections of the roll surface there no wicks are present). Where treatment is desired along the entire length of the yarn, a roll with the wicks evenly distributed throughout the surface will be selected. Combinations of different rolls with different wick configurations may be used to provide additional effects for the yarns. The dye or chemical treatment may be randomly applied or evenly applied across the entire length of the BCF yarn, as desired.

Where a chemical treatment such as an anti-soil or anti-stain composition is desired, it may be applied via an applicator other than that of the at least one rotating roll including wicks. When applied, the anti-soil may be applied subsequently to the dye.

The yarn speed of the BCF yarn will be greater than the surface speed of the roll including the wicks. For example, the BCF yarn may have a speed that is about 20 m/min to about 800 m/min higher than a surface speed of a rotating roll. The yarn speed of the BCF yarn may be about 50 m/min to about 1000 m/min, including about 100 to about 800 m/min. The speed of at least one rotating roll may be about 5 m/min to about 200 m/min, including about 50 m/min to about 100 m/min.

To control the amount of dye solution or other treatment that contacts the yarn is metered by the use of a pump. This permits precise application of the dye or chemical treatment to the desired amount. The amount may be varied over the length of the yarn.

Further, multiple rolls can be used in series. For example, one roll can apply a first color onto one side of the moving yarn and another roll to apply a second color onto the other side of the yarn to create a unique two color yarn. Further, two sets of nip rolls can be used. The first set can apply the primary color and the second set can apply a second color or performance enhancing chemical onto the yarn. Any combination of the above options can be used to make yarn with multiple colors, color depth and with various performance chemicals.

Aspects disclosed herein provide an apparatus and process that provides an energy efficient and environmentally friendly way to apply liquid dyes and/or performance chemicals onto carpet fibers. This can be used to make single or multi-color carpet fibers and with single or twisted BCF yarn. The color variations can be along the end and/or across the fiber bundle. It can also be used to make white dyeable carpet fibers with intermittent deep or light dyeability.

The apparatus of some aspects includes of one or multiple rotating rolls arranged in series. The surfaces of the rotating rolls are covered with wickers that are capable to transfer liquid dyes or performance chemicals evenly and continuously from the center to the surface of the rotating rolls. Carpet fibers are wrapped around the rolls to pick up dyes or performance chemicals at a significantly faster processing speed than the surface speed of the rotating rolls. Traverse guides may be included to oscillate fibers across the processing direction to assist dye pick up.

Each roll can be partially covered to provide intermittent application of dyes onto the moving fibers. By varying the roll rotating speed, the location and width of the covered portions, fibers with various color and color segment lengths can be produced at very low wet pick (10 to 30%). The color variations can be along or across the fiber bundle.

This device can be coupled with a heatset machine, such as Superba or Suessen to cure dyes, performance chemicals and at the same time to set the twist. This device provides a very efficient way to apply dyes onto fiber at very low wet pick up. There is no need to add extra rinsing and drying steps during or after dyeing and heat setting.

The advantages provided by the disclosed processes include: (1) Along the end and/or across the yarn bundle deep or light acid dyeability variations; (2) Along the end color variation; and (3) Multiple colors across the yarn bundle.

The wet pick-up of the anti-soil composition is between about 5 wt. % and about 50 wt. %., including between about 10 wt. % and about 30 wt %, about 20 wt. % to about 30 wt. %, and about 10 wt. % to about 20 wt. %. The resulting twisted BCF yarn, if a fluorine based anti-soil component is used, can have an on weight of fiber from about 100 ppm to about 1000 ppm elemental fluorine, including from about 100 to about 500 ppm elemental fluorine, from about 200 to about 400 ppm elemental fluorine, and from about 100 ppm to about 300 ppm elemental fluorine. If the anti-soil composition further comprises a stain blocker, it is present on weight of fiber from about 500 ppm to about 4%, including from about 1000 ppm to about 3%, from about 0.5% to about 2%, and from about 0.5% to about 1%.

The wet pick-up of the stain blocker composition is present on weight of fiber from about 500 ppm to about 4%, including from about 1000 ppm to about 3%, from about 0.5% to about 2%, and from about 0.5% to about 1%. Common stain blockers use sulfonated moieties as part of the chemistry, which results in the presence of sulfur on the treated fiber. The sulfur content can range from about 50 ppm with 5% stain blocker to about 1 ppm with 0.1% stain blocker on weight of fiber. Thus, based on the above stain blocker concentrations, the sulfur content on weight of fiber will range from about 0.5 ppm to about 40 ppm elemental sulfur, including from about 1 ppm to about 30 ppm elemental sulfur, from about 5 ppm to about 20 ppm elemental sulfur, and from about 5 ppm to about 10 ppm elemental sulfur. Sulfur content can be determined by x-ray diffraction or other methods.

The performance enhancing can further comprise one or more component selected from the group consisting of: odor control agents, anti-microbial agents, anti-fungal agents, fragrance agents, bleach resist agents, softeners, and UV stabilizers.

The single or twisted BCF yarn can be made from polyamide fibers, such as those made from nylon 6,6, nylon 6, nylon 4,6, nylon 6,10, nylon 10,10, nylon 12, its copolymers, and blends thereof. Further, the single or twisted BCF yarn can also have additional polymer components, such as polyester components. The additional polymer components can be incorporated with the polyamide (by melt-blend or co-polymerization) prior to making a polyamide fiber (e.g. a polyamide/polyester fiber), or can be stand-alone fibers that are twisted with the polyamide fibers to make the twisted BCF yarn. However, cationic dyeable nylon, polyester, and acrylic fiber may also be used either together or exclusively.

When only cationic dyeable nylon and/or polyester is present in the BCF yarn of the present invention, the use of a stain blocker is unnecessary. In other words, a stain blocker is excluded from the process, further streamlining and reducing costs and environmental exposure of these chemicals. A suitable cationic dyeable nylon may be any of the nylon compositions mentioned above, such as nylon 6 or nylon 66, that has been modified with sulfoisophthalic acid, sodium salt as a co-monomer, such as 5-sulfoisophthalic acid.

As stated above, the BCF yarn can be manufactured with polyamide, and/or polyester polymer components. An unexpected benefit of the disclosed process has been discovered in that, whereas a small amount of anti-soil composition is applied compared to known exhaust processes, a high anti-soil component content, such as fluorine, is achieved on the surface of the yarn. Further, the anti-soil composition applied in the process of the disclosed invention can be either fluorochemical or non-fluorochemical based, or a mixture of fluorochemical or fluoropolymer material with non-fluorinated soil resistant materials.

The disclosed process may be applied to yarns that do not require subsequent dyeing, having either a pigment or pigment included in their composition prior to twisting. The pigmented yarns can be made by acid solution dyed as well as disperse, cationic and anionic dyed fibers. Yarns suitable for use in the process may further comprise inherent stain resistance, whether by base composition as in the case of polyester, or by the inclusion of strong acid functionality in the polymer composition of the yarn, as in the case of nylon. Use of dyed or pigmented yarns (i.e. colored yarns) with the disclosed process eliminates the need for subsequent dyeing and enables the creation of colored carpets that improve inventory flexibility, improve color options, are stain resistant, and are soil resistant, without the need for subsequent dyeing and performance enhancing chemical applications as practiced under the current state of the art. soil resistant chemical application.

Where both inherently stain resistant and colored yarns are employed in the disclosed process, then all of the cost of dyeing, and of SB/FC application to the tufted carpet are eliminated. As observed above, this not only reduces the cost of making carpets having superior performance attributes, but also minimizes the environmental impact of carpet manufacture by reducing water, steam and energy consumption.

The twisted BCF yarn made with the various aspects of the disclosed process, by itself or blended with non-treated fibers and yarns, can be tufted and manufactured into carpets or fabrics. Carpets made with the twisted BCF yarn exhibit an oil repellency rating of 5 or higher and a water repellency rating of 5 or higher.

Alternatively, the disclosed process can also be advantageously applied in certain processes where a styling advantage might be derived from differential dyeing and finishing after carpet formation. For example, a soil resistant or stain resistant twisted yarn of the disclosed invention could optionally be tufted into a carpet among untreated yarns prior to dyeing, thus creating an aesthetic alternative.

Further disclosed is a system for applying the anti-soil composition to the twisted BCF yarn. The system includes: (a) a first yarn take-up device that transmits a single yarn member made from at least two individual yarn members; (b) an anti-soil composition applicator disposed downstream of the first yarn take-up device that applies the anti-soil composition to the single yarn member; (c) a yarn dry heat setting apparatus; and (d) a second yarn take-up device that receives the single yarn member. The first yarn take-up device can be a take-up roll or reel that can twist the at least two individual yarn members into a single yarn member. The individual yarn members can be single filaments or fibers, or yarns made from a plurality of filaments or fibers. The applicator can be any suitable device that applies wet ingredients to a dry substrate, including, but not limited to: applicator pad, nip rollers, wet-wick, dip-tank, sprayer, and mister. The wet pick-up of composition is between about 5 wt. % and about 50 wt. %., including between about 10 wt. % and about 30 wt %, about 20 wt. % to about 30 wt. %, and about 10 wt. % to about 20 wt. %. The resulting twisted BCF yarn, if a fluorine based anti-soil component is used, can have an on weight of fiber from about 100 ppm to about 1000 ppm elemental fluorine, including from about 100 to about 500 ppm elemental fluorine, from about 200 to about 400 ppm elemental fluorine, and from about 100 ppm to about 300 ppm elemental fluorine. If the anti-soil composition further comprises a stain blocker, it is present on weight of fiber from about 500 ppm to about 4%, including from about 1000 ppm to about 3%, from about 0.5% to about 2%, and from about 0.5% to about 1%. The system can also include a false twisting apparatus and a stuffer box disposed before the heat setting apparatus. The false twisting apparatus can be a yarn hold-up unit for prevention of filament breaks. The texturizing unit can be a stuffer box. The heat setting apparatus can be a Suessen unit. The second yarn take-up device can be a winder.

Alternatively, the disclosed process can be modified to include dye application, optional anti-stain application and/or anti-soil application after the twisted BCF yarn is wound and prior to heat setting. For example, the twisted BCF yarn is unwound from a core or package, contacts the dye applicator, contacts the optional anti-stain applicator, and contacts the anti-soil applicator, then goes through a heat setting process to lock in the yarn twist, dye, anti-soil, and optional anti-stain.

If a fluorine based anti-soil component is used, can have an on weight of fiber from about 100 ppm to about 1000 ppm elemental fluorine, including from about 100 to about 500 ppm elemental fluorine, from about 200 to about 400 ppm elemental fluorine, and from about 100 ppm to about 300 ppm elemental fluorine. If the anti-soil composition further comprises a stain blocker, it is present on weight of fiber from about 500 ppm to about 4%, including from about 1000 ppm to about 3%, from about 0.5% to about 2%, and from about 0.5% to about 1%. The system can also include a false twisting apparatus and a stuffer box disposed before the heat setting apparatus. The false twisting apparatus can be a yarn hold-up unit for prevention of filament breaks. The texturizing unit can be a stuffer box. The heat setting apparatus can be a Suessen unit. The second yarn take-up device can be a winder.

In a cable twisting process, a creel yarn and a bucket yarn, which is fed at a spindle speed of 7000 rpm, pass through an anti-balloon device and onto a take-up roll. From here, the twisted yarn is wound up on a winder.

Another aspect of the disclosed process includes two or more treatments such as both a dye applicator and anti-stain/anti-soil applicator. In this aspect, a creel yarn and bucket yarn, which is fed at a spindle speed of 7000 rpm, pass through an anti-balloon device and onto a take-up roll. A dye applicator is disposed downstream of take-up roll, which applies a first treatment, namely a dye component to the twisted yarn. An anti-soil/anti-stain applicator is disposed downstream of the dye applicator, which applies an anti-soil/anti-stain component to the dyed, twisted yarn. From here, the twisted and treated yarn is wound up on a winder.

In a suitable heat setting process, cable twisted BCF yarn enters a false twisting unit, followed by a coiler or stuffer box, prebulker, and finally a heatset chamber to produce a heatset yarn.

In an aspect of the disclosed process, where the cable twisted BCF yarn is dyed prior to heat setting, the cable twisted BCF yarn enters the dye applicator (or other treatment applicator), followed by a false twisting unit, a coiler or stuffer box, prebulker, and finally a heatset chamber to produce a dyed, heatset yarn.

In a cable twisting process, a creel yarn and a bucket yarn, which is fed at a spindle speed of 7000 rpm, pass through an anti-balloon device and onto a take-up roll. From here, the twisted yarn is wound up on a winder.

In one aspect of the disclosed process, a creel yarn and bucket yarn, which is fed at a spindle speed of 7000 rpm, pass through anti-balloon device and onto a take-up roll. A dye applicator is disposed downstream of take-up roll, which applies a dye component or other treatment to the twisted yarn. From here, the twisted and dyed yarn is wound up on a winder.

Another aspect of the disclosed process includes two or more treatments such as both a dye applicator and anti-stain/anti-soil applicator. In this aspect, a creel yarn and bucket yarn, which is fed at a spindle speed of 7000 rpm, pass through an anti-balloon device and onto a take-up roll. A dye applicator is disposed downstream of take-up roll, which applies a first treatment, namely a dye component to the twisted yarn. An anti-soil/anti-stain applicator is disposed downstream of the dye applicator, which applies an anti-soil/anti-stain component to the dyed, twisted yarn. From here, the twisted and treated yarn is wound up on a winder.

In a suitable heat setting process, cable twisted BCF yarn enters a false twisting unit, followed by a coiler or stuffer box, prebulker, and finally a heatset chamber to produce a heatset yarn.

In an aspect of the disclosed process, where the cable twisted BCF yarn is dyed prior to heat setting, the cable twisted BCF yarn enters the dye applicator (or other treatment applicator), followed by a false twisting unit, a coiler or stuffer box, prebulker, and finally a heatset chamber to produce a dyed, heatset yarn.

The disclosed process is counterintuitive and surprisingly results in yarn that contains acceptable dyed and performance enhancement properties when manufactured into a carpet or fabric. One would expect that rearranging the process as described above would fowl up down-stream carpet manufacturing processes and lead to poor quality carpet. Thus, the results reported below are surprising and unexpected.

The features and advantages of the present invention are more fully shown by the following examples which are provided for purposes of illustration, and are not to be construed as limiting the invention in any way.

EXAMPLES

Test Methods

Acid Dye Stain Test.

Acid dye stain resistance is evaluated using a procedure modified from the American Association of Textile Chemists and Colorists (AATCC) Method 175-2003, "Stain Resistance: Pile Floor Coverings." 9 wt % of aqueous staining solution is prepared, according to the manufacturer's directions, by mixing cherry-flavored KOOL-AID® powder (Kraft/General Foods, Northfield, Ill./White Plains, N.Y., a powdered drink mix containing, inter alia, FD&C Red No. 40). A carpet sample (4×6-inch) is placed on a flat non-absorbent surface. A hollow plastic 2-inch (5.1 cm) diameter cup is placed tightly over the carpet sample. Twenty mL of the KOOL-AID® staining solution is poured into the cup and the solution is allowed to absorb completely into the carpet sample. The cup is removed and the stained carpet sample is allowed to sit undisturbed for 24 hours. Following incubation, the stained sample is rinsed thoroughly under cold tap water, excess water is removed by centrifugation, and the sample is dried in air. The carpet sample was visually inspected and rated for staining according to the FD&C Red No. 40 Stain Scale described in AATCC Method 175-2003. Stain resistance is measured using a 1-10 scale. An undetectable test staining is accorded a value of 10.

Oil and Water Repellency Tests

The following liquids were used for oil repellency tests:

| Rating Number | Liquid Composition |
|---|---|
| 1 | Kaydol (Mineral Oil) |
| 2 | 65%/35% Kaydol/n-Hexadecane |
| 3 | n-Hexadecane |
| 4 | n-Tetradecane |
| 5 | n-Dodecane |
| 6 | n-Decane |

The following liquids were used for water repellency tests:

| Rating | Liquid Composition | |
|---|---|---|
| Number | % Isopropanol | % Water |
| 1 | 2 | 98 |
| 2 | 5 | 95 |
| 3 | 10 | 90 |
| 4 | 20 | 80 |
| 5 | 30 | 70 |
| 6 | 40 | 60 |

Repellency Test Procedure

Five drops of rating number 1 liquid are placed from a height of 3 mm onto the carpet surface. If after 10 seconds, four out of the five drops were still visible as spherical to hemispherical, the carpet is given a passing rating. Repeat the test with a higher rating number liquid. The repellency rating of the sample is the highest rating number liquid used to pass the repellency test. Carpets with a rating of 4 or higher have good anti-soiling properties. Without anti-soil treatment, most nylon carpets have a rating of 1 for both oil and water repellency.

Example 1

Four ends of nylon 66 acid dyeable yarn (996-426TS from Invista) were cable twisted together to form a ~4000 denier cable twisted yarn. This yarn was processed on a pair of rotating rolls covered with cotton wicks (figure 1) of current invention. Light color premetalized dyes (Isolan yellow NW 23 g/l, Red S-RL 4.52 g/l, Black 2S-CP 0.88 g/l by Dystar, Arrowperse CX 15 g/l by Arrow Engineering, pH 4.5) were pumped from the center and dispersed evenly in the wicks on the top roll. Dark color premetalized dyes (Isolan Yellow NW 9.57 g/l, Red S-RL 13.4 g/l and Black 2S-CP 26.1 g/l by Dystar, Arrowperse CX 15 g/l by Arrow Engineering, pH 4.5) were pumped from the center and dispersed evenly in the wicks on the bottom roll. Both rolls (18 inches in diameter) were rotated at surface speed about 60 mpm (meters per minute). The 4000 denier Nylon 66 acid dyeable yarn was processed at 315 mpm, first picked up dyes on the top and bottom rolls and subsequently heatset on Suessen at 200° C. for 60 seconds. The dyed and heatset yarn had an interesting subtle mixture of light and dark colors along and across the fiber. The test yarn was converted into ⅛ gauge, ⅝ inch pile height, 25 oz loop pile carpets. The finished carpet had a unique aesthetics with numerous color striations, very similar to antique oriental carpets.

Example 2

Two ends of 1245 denier 19 dpf acid dyeable hollow filament yarn from Invista (1245-296A) were cable twisted (5.5 tpi) on Volkman. The cable twisted yarn (single end) was processed on a pair of rotating rolls of current invention (figure 1). Dark color premetalized dyes (Isolan Yellow NW 9.57 g/l, Red S-RL 13.4 g/l and Black 2S-CP 26.1 g/l by Dystar, Arrowperse CX 15 g/l by Arrow Engineering, pH 4.5) were used on the top roll and light color premetalized dyes (Isolan yellow NW 23 g/l, Red S-RL 4.52 g/l, Black 2S-CP 0.88 g/l by Dystar, Arrowperse CX 15 g/l by Arrow Engineering, pH 4.5) were used on the bottom roll. The dye solution flow rate was controlled about 0.013 gallon/hour for both top and bottom rolls. About 50% of top roll (9 to 3 o'clock) and 50% of the bottom roll (12 to 6 o'clock) were blocked with tapes to prevent dyes been picked up by the moving fibers (~350 ypm). Both rolls (18 inches in diameter) were rotated at surface speed about 68 mpm. After intermittent dye application, the cable twisted yarn was heatset on Superba with 129° C. saturated steam for 30 seconds and wound on tube. It was an interesting multicolor yarn with segments of light, medium and dark colors of different shades.

Example 3

Two ends of 1245 denier 19 dpf light wheat color solution dyed Nylon 66 yarn (1245-C289 by Invista) made from cationic dyeable polymer were cable twisted (5.5 tpi) on Volkman. Four ends of this cable twisted yarn were processed on a pair of rotating rolls of current invention. Light color premetalized dyes (Isolan yellow NW 23 g/l, Red S-RL 4.52 g/l, Black 2S-CP 0.88 g/l by Dystar, Arrowperse CX 15 g/l by Arrow Engineering, pH 4.5) were used on the top roll. The top roll was rotating in the process direction at surface speed about 141 mpm. Dark color premetalized dyes (Isolan Yellow NW 9.57 g/l, Red S-RL 13.4 g/l and Black 2S-CP 26.1 g/l by Dystar, Arrowperse CX 15 g/l by Arrow Engineering, pH 4.5) were used on the bottom roll. The bottom roll was rotating in the processing direction at a surface speed about 183 mpm. About 50% of top roll (9 to 3 o'clock) and 50% of the bottom roll (12 to 6 o'clock) were blocked with tapes to prevent dyes been picked up by the moving fibers (~280 mpm). After intermittent dye application, the cable twisted yarn was heatset on Superba with 138° C. saturated steam for 30 seconds and wound on tubes. The finished yarn had an interesting multicolor space dyed look with segments of light, medium and dark colors of different shades. The color spacing varied from ½ to 10 inches.

Example 4

This example was produced similar to example 3 except there was no blocking on both rolls. This item had subtle color variations alone and across the yarn bundle.

Example 5

Two ends of 1100 denier, 6 dpf, polyester BCF were cable twisted (5.5 tpi) on Volkman. Four ends of this cable twisted yarn were processed on a pair of rotating rolls of current invention. Light color disperse dyes (Dianix yellow E-3GE 9.5 g/l, red E-FB 8.4 g/l and blue ER-AM 4.0 g/l by Dystar, pH 4.5) were used on the top roll and dark color disperse dyes (Dianix yellow E-3GE 23.7 g/l, red E-FB 13.7 g/l and blue ER-AM 6.2 g/l by Dystar, pH 4.5) were used on the bottom roll. The top roll was rotating in the process direction at surface speed about 141 mpm. The bottom roll was rotating in the processing direction at a surface speed about 183 mpm. About 50% of top roll (9 to 3 o'clock) and 50% of the bottom roll (12 to 6 o'clock) were blocked with tapes to prevent dyes been picked up by the moving fibers (~280 mpm). After intermittent dye application, the cable twisted yarn was heatset on Superba with 143° C. saturated steam for 30 seconds and wound on tubes. The finished yarn had an interesting multicolor space dyed look with segments of light, medium and dark colors of different shades. The color spacing varied from ½ to 12 inches.

Example 6

This example was produced similar to example 5 except there was no blocking on both rolls. This item had subtle color variations alone and across the yarn bundle.

Example 7

Four ends of cable twisted acrylic staple yarns were processed on a pair of rotating rolls of current invention. Gold color cationic dyes (Maxilon yellow GL 2.66 WI, Sevron liq. YCN 15.99 g/l, Permacryl blue NCN 1.66 g/l) were used on the top roll and dark green cationic dyes (Maxilon yellow GL 2.46 g/l, Sevron liq. YCN 30 g/l, Permacryl blue NCN 20.7 g/l) were used on the bottom roll. The top roll was rotating in the processing direction at surface speed about 141 mpm and the bottom roll was rotating in the processing direction at a surface speed about 183 mpm. After dye application, the staple acrylic yarns were heatset on Superba with 115 C saturated steam for 30 seconds and wound on tubes. The finished yarn had an interesting mixture of yellow to green of various shades.

The invention has been described above with reference to the various aspects of the disclosed treatment process, treated fibers, carpets, fabrics, and systems used to apply anti-soil compositions to BCF yarn. Obvious modifications and alterations will occur to others upon reading and understanding the proceeding detailed description. It is intended that the invention be construed as including all such modifications and alterations insofar as they come within the scope of the claims.

What is claimed is:

1. A process for continuously applying a treatment to a single or twisted BCF yarn comprising:

a. providing a single or twisted BCF (bulked continuous filament) yarn;

b. winding said yarn on a take up reel;

c. providing at least one rotating roll including a plurality of wicks for providing a dye treatment;

d. contacting said wicks with said dye treatment;

e. contacting said BCF yarn to apply the dye with said wicks to the BCF yarn while in motion prior to winding said yarn on said take up reel;

f. providing one or more applicators for one or more performance enhancing compositions after said at least one rotating roll;

g. applying the performance enhancing composition to said dyed BCF yarn while still in motion and without steam fixation and rinsing of said dyed BCF yarn prior to winding said yarn on said take up reel; and h. heat setting said dyed and performance enhancing treated BCF yarn prior to winding said yarn on said take up reel, wherein said yarn exhibits at least equivalent dyeing and enhancing composition performance to processes involving steam and rinsing between dyeing and application of performance enhancing compositions.

2. The process of claim 1, further comprising a second rotating roll or multiple rotating rolls for application of the one or more performance enhancing compositions.

3. The process of claim 1, wherein said performance enhancing composition is selected from the group consisting of an anti-soil composition, an anti-stain composition and combinations thereof.

4. The process of claim 1, wherein said at least one rotating roll includes wicks evenly distributed on a yarn contacting surface of said at least one rotating roll.

5. The process of claim 1, wherein said at least one rotating roll includes wicks only in selected sections of said yarn contacting surface of said at least one rotating roll.

6. The process of claim 5, wherein said at least one rotating roll includes a portion of said yarn contacting surface where no wicks are present.

7. The process of claim 1, wherein said BCF yarn is processed at a yarn speed of about 50 m/min to about 1000 m/min.

8. The process of claim 1, wherein said at least one rotating roll has a surface speed of about 5 m/min to about 200 m/min.

9. The process of claim 1, wherein a speed of said BCF yarn is about 20 m/min to about 800 m/min higher than a surface speed of said at least one rotating roll.

10. The process of claim 3, wherein said anti-soil composition is selected from the group consisting of: fluorochemicals, silicones, silsesquioxanes, silane-modified particulates, organosilane-modified particulates, alkylated particulates, anionic surfactants, and anionic hydrotropes.

11. The process of claim 1, wherein the anti-soil composition has a pH from about 3 to about 8.

12. The process of claim 10, wherein said fluorochemical has less than or equal to six fluorinated carbons.

13. The process of claim 3, wherein said anti-soil composition further comprises a composition selected from the group consisting of: odor control agents, anti-microbial agents, anti-fungal agents, fragrance agents, bleach resist agents, softeners, and UV stabilizers.

14. The process of claim 3, wherein said anti-soil composition further comprises an anti-stain composition.

15. The process of claim 3, wherein said anti-stain composition is selected from the group consisting of: syntans, sulfonated novolacs, sulfonated aromatic aldehyde condensation products (SACs) and/or reaction products of formaldehyde, phenolics, substituted phenolics, thiophenolics, sulfones, substituted sulfones, polymers or copolymers of olefins, branched olefins, cyclic olefins, sulfonated olefins, acrylates, methacrylates, maleic anhydride and organosulfonic acids.

16. The process of claim 3, wherein said anti-stain composition is present at an on weight of fiber from about 500 ppm to about 4%.

17. The process of claim 3, wherein said anti-soil composition further comprises a composition selected from the group consisting of: dye auxiliaries, sequestrants, pH control agents, and surfactants.

18. The process of claim 1, wherein said heat setting is performed at a temperature from about 125° C. to about 200° C.

19. The process of claim 1, wherein said BCF yarn includes at least one fiber selected from the group consisting of polyamide fiber, polyester fiber, acrylic fiber, and combinations thereof.

20. The process of claim 1, wherein said BCF yarn comprises nylon.

21. The process of claim 1, wherein said BCF yarn comprises a polyester.

22. The process of claim 3, wherein said anti-soil composition is present at an on weight of fiber from about 100 ppm elemental fluorine to about 1000 ppm elemental fluorine.

23. The process of claim 1, wherein traverse guides oscillate fibers across the process direction to assist dye pickup.

24. The process of claim 1, wherein a meter pump supplies said treatment to the wicks through a plurality of capillaries from within said at least one rotating roll.

* * * * *